US007750884B2

(12) United States Patent
Kwon et al.

(10) Patent No.: US 7,750,884 B2
(45) **Date of Patent: *Jul. 6, 2010**

(54) METHOD AND APPARATUS OF DRIVING LIQUID CRYSTAL DISPLAY DEVICE

(75) Inventors: Keuk Sang Kwon, Kyongsangbuk-do (KR); Kwang Soon Park, Daegu-kwangyokshi (KR)

(73) Assignee: LG Display Co., Ltd., Seoul (KR)

( * ) Notice: Subject to any disclaimer, the term of this patent is extended or adjusted under 35 U.S.C. 154(b) by 886 days.

This patent is subject to a terminal disclaimer.

(21) Appl. No.: 11/505,452

(22) Filed: Aug. 17, 2006

(65) Prior Publication Data

US 2007/0188432 A1 Aug. 16, 2007

Related U.S. Application Data

(62) Division of application No. 10/413,998, filed on Apr. 16, 2003, now Pat. No. 7,113,160.

(30) Foreign Application Priority Data

Dec. 21, 2002 (KR) ..... 10-2002-0082080

(51) Int. Cl.
*G09G 3/36* (2006.01)

(52) U.S. Cl. ..... 345/99; 345/100

(58) Field of Classification Search ..... 345/87–104, 345/204–215; 349/38–39, 41–42
See application file for complete search history.

(56) References Cited

U.S. PATENT DOCUMENTS

| | | | | |
|---|---|---|---|---|
| 6,414,665 | B2 | 7/2002 | Libsch et al. | |
| 6,476,787 | B1 | 11/2002 | Libsch et al. | |
| 6,927,830 | B2 | 8/2005 | Chung et al. | |
| 7,113,160 | B2 * | 9/2006 | Kwon et al. | 345/99 |
| 2001/0045925 | A1 | 11/2001 | Libsch et al. | |

FOREIGN PATENT DOCUMENTS

| | | | |
|---|---|---|---|
| KR | 2001-0001483 | A | 1/2001 |
| KR | 2002-0045529 | A | 6/2002 |

* cited by examiner

*Primary Examiner*—Kevin M Nguyen
*Assistant Examiner*—Cory A Almeida
(74) *Attorney, Agent, or Firm*—McKenna Long & Aldridge LLP

(57) ABSTRACT

A method and apparatus of driving a liquid crystal display device is disclosed in the present invention. The liquid crystal display device includes a plurality of data lines, a plurality of gate lines crossing the data lines, a plurality of first liquid crystal cells on a first side of the data lines, a plurality of second liquid crystal cells on a second side of the data lines, a first switching part in each of the first liquid crystal cells and controlled by the $i^{th}$ gate line and the $(i+2)^{th}$ gate line (wherein i is a natural number), and a second switching part in each of the second liquid crystal cells and controlled by the $i^{th}$ gate line.

8 Claims, 12 Drawing Sheets

METHOD AND APPARATUS OF DRIVING LIQUID CRYSTAL DISPLAY DEVICE

This application is a divisional of U.S. patent application Ser. No. 10/413,998, filed Apr. 16, 2003, now U.S. Pat. No. 7,113,160, now allowed, which is hereby incorporated by reference.

This application claims the benefit of the Korean Patent Application No. P2002-082080 filed on Dec. 21, 2002, which Is hereby incorporated by reference.

BACKGROUND OF THE INVENTION

1. Field of the Invention

The present invention relates to a liquid crystal display device, and more particularly, to a method and apparatus of driving a liquid crystal display device. Although the present invention is suitable for a wide scope of applications, it is particularly suitable for reducing the number of data lines and the number of data driver IC's.

2. Discussion of the Related Art

A liquid crystal display device controls light transmittance of liquid crystals by using an electric field to display a picture. To this end, the liquid crystal display device includes a liquid crystal display panel having a pixel matrix and a driving circuit for driving the liquid crystal display panel. The driving circuit drives the pixel matrix so that picture information can be displayed on the display panel.

FIG. 1 illustrates a schematic view of a related art liquid crystal display device.

Referring to FIG. 1, the related art liquid crystal display device includes a liquid crystal display panel 2, a data driver 4 driving a plurality of data lines DL1 to DLm of the liquid crystal display panel 2, a gate driver 6 driving a plurality of gate lines GL1 to GLn of the liquid crystal display panel.

The liquid crystal display panel 2 further includes a thin film transistor TFT formed at each intersection of the gate lines GL1 to GLn and the data line DL1 to DLm, and liquid crystal cells connected to the thin film transistors and arranged in a matrix form.

The gate driver 6 sequentially applies gate signals to the gate lines GL1 to GLn in accordance with control signals from a timing controller (not shown). The data driver 4 converts data R, G, and B supplied from the timing controller into video signals as analog signals, and applies the video signals of one horizontal line portion to the data lines DL1 to DLm for each horizontal period when the gate signals are applied to the gate lines GL1 to GLn.

The thin film transistor TFT applies data from the data lines DL1 to DLm to the liquid crystal cells in response to the gate signals from the gate lines GL1 to GLn. The liquid crystal cell is composed of a pixel electrode connected to the TFT and a common electrode facing into each other with the liquid crystal therebetween, thus it can be expressed equivalent to a liquid crystal capacitor Clc. Such a liquid crystal cell includes a storage capacitor (not shown) connected to the previous gate line in order to sustain the data voltage charged in the liquid crystal capacitor Clc until the next data voltage is charged.

In this way, the liquid crystal cells of the related art liquid crystal display panel are located at intersections of the gate lines GL1 to GLn and the data lines DL1 to DLm, respectively. Thus, there are vertical lines formed as many as the data lines DL1 to DLm (i.e., m vertical lines). In other words, the liquid crystal cells are arranged in a matrix to form m vertical lines and n horizontal lines.

As can be seen here, the m data lines DL1 to DLm are required for driving the liquid crystal cells of the m horizontal lines. Accordingly, there is a disadvantage in that the processing time and fabricating cost are not efficient because a plurality of data lines DL1 to DLm are formed for driving the liquid crystal display panel 2 in the related art. Further, there is a problem in that the fabricating cost becomes high because a number of data driver IC's are required in the data driver 4 for driving each of the m data lines DL1 to DLm.

SUMMARY OF THE INVENTION

Accordingly, the present invention is directed to a method and apparatus of driving a liquid crystal display device that substantially obviates one or more of problems due to limitations and disadvantages of the related art.

Another object of the present invention is to provide a method and apparatus of driving a liquid crystal display device that is adaptive for reducing the number of data lines and the number of data driver IC's.

Additional features and advantages of the invention will be set forth in the description which follows and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a liquid crystal display device includes a plurality of data lines, a plurality of gate lines crossing the data lines, a plurality of first liquid crystal cells on a first side of the data lines, a plurality of second liquid crystal cells on a second side of the data lines, a first switching part in each of the first liquid crystal cells and controlled by the $i^{th}$ gate line and the $(i+2)^{th}$ gate line (wherein i is a natural number), and a second switching part in each of the second liquid crystal cells and controlled by the $i^{th}$ gate line.

Herein, the first switching part applies a video signal supplied to the data lines to the first liquid crystal cells, when a gate signal is applied to the $i^{th}$ gate line and the $(i+2)^{th}$ gate line.

Herein, the second switching part applies a video signal supplied to the data lines to the second liquid crystal cells, when a gate signal is applied to the $i^{th}$ gate line.

Herein, the first and second switching parts are turned on for a first period to apply a video signal supplied to the data lines to the first liquid crystal cells, and turned on for a second period after the first period to apply the video signal supplied to the data lines to the second liquid crystal cells.

Herein, the first switching part is located on the first side of the data lines.

Herein, the second switching part is located on the second side of the data lines.

Herein, the first switching part is located on the second side of the data lines.

Herein, the second switching part is located on the first side of the data lines.

Herein, the first switching part includes a first thin film transistor having a first gate terminal connected to the $i^{th}$ gate line and a first source terminal connected to the $(i+2)^{th}$ gate line, and a second thin film transistor having a second gate terminal connected to a first drain terminal of the first thin film transistor, a second source terminal connected to the data lines, and a second drain terminal connected to the first liquid crystal cells.

Herein, each of the first and second thin film transistors includes a gate electrode on a substrate, a gate insulating layer on the gate electrode, a semiconductor layer on the gate insulating layer, a source electrode and a drain electrode on the semiconductor layer, and a protective layer on the source electrode and the drain electrode.

Herein, the semiconductor layer includes an undoped active layer on the gate insulating layer, and a doped ohmic contact layer on the active layer.

Herein, the semiconductor layer, the source electrode, and the drain electrode are formed with the same mask.

Herein, the semiconductor layer, the source electrode, and the drain electrode are formed with different masks.

Herein, the second switching part includes a third thin film transistor having a third gate terminal connected to the $i^{th}$ gate line, a third source terminal connected to the data lines, and a third drain terminal connected to the second liquid crystal cells.

Each of the third thin film transistors includes a gate electrode on a substrate, a gate insulating layer on the gate electrode, a semiconductor layer on the gate insulating layer, a source electrode and a drain electrode on the semiconductor layer, and a protective layer on the source electrode and the drain electrode.

Herein, the semiconductor layer includes an undoped active layer on the gate insulating layer, and a doped ohmic contact layer on the active layer.

Herein, the semiconductor layer, the source electrode, and the drain electrode are formed with the same mask.

Herein, the semiconductor layer, the source electrode, and the drain electrode are formed with different masks.

In another aspect of the present invention, a liquid crystal display device includes a plurality of data lines, a plurality of gate lines crossing the data lines, a plurality of first liquid crystal cells on a first side of the data lines, a plurality of second liquid crystal cells on a second side of the data lines, a first switching part in each of the first liquid crystal cells and controlled by the $i^{th}$ gate line and the $(i+2)^{th}$ gate line (wherein i is a natural number), and a second switching part in each of the second liquid crystal cells and controlled by the $i^{th}$ gate line, wherein the first switching part and the second switching part are alternately arranged with respect to the data lines.

Herein, the first liquid crystal cells and the first switching part are located in odd-numbered vertical lines of even-numbered horizontal lines, and the second liquid crystal cells and the second switching part are located in even-numbered vertical lines of even-numbered horizontal lines.

Herein, the first liquid crystal cells and the first switching part are located in even-numbered vertical lines of odd-numbered horizontal lines, and the second liquid crystal cells and the second switching part are located in odd-numbered vertical lines of odd-numbered horizontal lines.

Herein, the first liquid crystal cells and the first switching part are located in odd-numbered vertical lines of odd-numbered horizontal lines, and the second liquid crystal cells and the second switching part are located in even-numbered vertical lines of odd-numbered horizontal lines.

Herein, the first liquid crystal cells and the first switching part are located in even-numbered vertical lines of even-numbered horizontal lines, and the second liquid crystal cells and the second switching part are located in odd-numbered vertical lines of even-numbered horizontal lines.

In another aspect of the present invention, a driving apparatus of a liquid crystal display device includes a data driver applying a video signal to data lines, and a gate driver applying first and second gate signals to gate lines, wherein the second gate signal applied to the $i^{th}$ gate line overlapping the first gate signal applied to the $(i+2)^{th}$ gate line (wherein i is a natural number).

Herein, the second gate signal has a width wider than the first gate signal.

In another aspect of the present invention, a method of driving a liquid crystal display device includes applying a gate signal to the $i^{th}$ gate line and the $(i+2)^{th}$ gate line in order to apply a video signal to a first liquid crystal cell located in the $i^{th}$ horizontal line (wherein i is a natural number), and applying a gate signal to the $i^{th}$ gate line in order to apply the video signal to a second liquid crystal cell located in the $i^{th}$ horizontal line and adjacent to the first liquid crystal cell for sharing the same data line.

In another aspect of the present invention, a liquid crystal display device includes a plurality of data lines, a plurality of gate lines crossing the data lines, a plurality of first liquid crystal cells on a first side of the data lines, a plurality of second liquid crystal cells on a second side of the data lines, a first switching part in each of the first liquid crystal cells and applying a video signal from the data lines to the first liquid crystal cells, and a second switching part in each of the second liquid crystal cells and applying the video signal from the data lines to the second liquid crystal cells, wherein the first switching part includes a first thin film transistor having a first source terminal connected to the $i^{th}$ gate line and a first gate terminal connected to the $(i+1)^{th}$ gate line (wherein i is a natural number), and a second thin film transistor having a second gate terminal connected to a second drain terminal of the first thin film transistor, a second source terminal connected to the data lines, and a second drain terminal connected to the first liquid crystal cells, and the second switching part includes a third thin film transistor having a third gate terminal connected to the $i^{th}$ gate line, a third source terminal connected to the data lines, and a third drain terminal connected to the second liquid crystal cells.

Herein, the first switching part applies a video signal supplied to the data lines to the first liquid crystal cells, when a gate signal is applied to the $i^{th}$ gate line and the $(i+1)^{th}$ gate line.

Herein, the second switching part applies a video signal supplied to the data lines to the second liquid crystal cells, when a gate signal is applied to the $i^{th}$ gate line.

Herein, the first and second switching parts are simultaneously turned on for a first period to apply a video signal supplied to the data lines to the first liquid crystal cells, and only the second switching part is turned on for a second period after the first period to apply the video signal supplied to the data lines to the second liquid crystal cells.

Herein, the first switching part is located on the first side of the data lines, and the second switching part is located on the second side of the data lines.

Herein, the first switching part is located on the second side of the data lines, and the second switching part is located on the first side of the data lines.

In a further aspect of the present invention, a liquid crystal display device includes a plurality of data lines, a plurality of gate lines crossing the data lines, a plurality of first liquid crystal cells and a plurality of second liquid crystal cells alternately arranged with respect to the data lines, a first switching part in each of the first liquid crystal cells and applying a video signal from the data lines to the first liquid crystal cells, and a second switching part in each of the second liquid crystal cells and applying the video signal from the data lines to the second liquid crystal cells, wherein the first switching part includes a first thin film transistor having a first source terminal connected to the $i^{th}$ gate line and a first gate terminal connected to the $(i+1)^{th}$ gate line (wherein i is a natural number), and a second thin film transistor having a second gate terminal connected to a second drain terminal of the first thin film transistor, a second source terminal connected to the data lines, and a second drain terminal connected to the first liquid crystal cells, and the second switching part includes a third thin film transistor having a third gate terminal connected to the $i^{th}$ gate line, a third source terminal connected to the data lines, and a third drain terminal connected to the second liquid crystal cells.

Herein, the first liquid crystal cells and the first switching part are located in odd-numbered vertical lines of even-numbered horizontal lines, and the second liquid crystal cells and the second switching part are located in even-numbered vertical lines of even-numbered horizontal lines.

Herein, the first liquid crystal cells and the first switching part are located in even-numbered vertical lines of odd-numbered horizontal lines, and the second liquid crystal cells and the second switching part are located in odd-numbered vertical lines of odd-numbered horizontal lines.

Herein, the first liquid crystal cells and the first switching part are located in odd-numbered vertical lines of odd-numbered horizontal lines, and the second liquid crystal cells and the second switching part are located in even-numbered vertical lines of odd-numbered horizontal lines.

Herein, the first liquid crystal cells and the first switching part are located in even-numbered vertical lines of even-numbered horizontal lines, and the second liquid crystal cells and the second switching part are located in odd-numbered vertical lines of even-numbered horizontal lines.

Herein, each of the first to third thin film transistors includes a gate electrode on a substrate, a gate insulating layer on the gate electrode, a semiconductor layer on the gate insulating layer, a source electrode and a drain electrode on the semiconductor layer, and a protective layer on the source electrode and the drain electrode.

Herein, the semiconductor layer includes an undoped active layer on the gate insulating layer, and a doped ohmic contact layer on the active layer.

Herein, the semiconductor layer, the source electrode, and the drain electrode are formed with the same mask.

Herein, the semiconductor layer, the source electrode, and the drain electrode are formed with different masks.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention.

In the drawings.

DETAILED DESCRIPTION OF THE ILLUSTRATED EMBODIMENTS

Reference will now be made in detail to the illustrated embodiments of the present invention, examples of which are illustrated in the accompanying drawings. Wherever possible, the same reference numbers will be used throughout the drawings to refer to the same or like parts.

Figure 2:
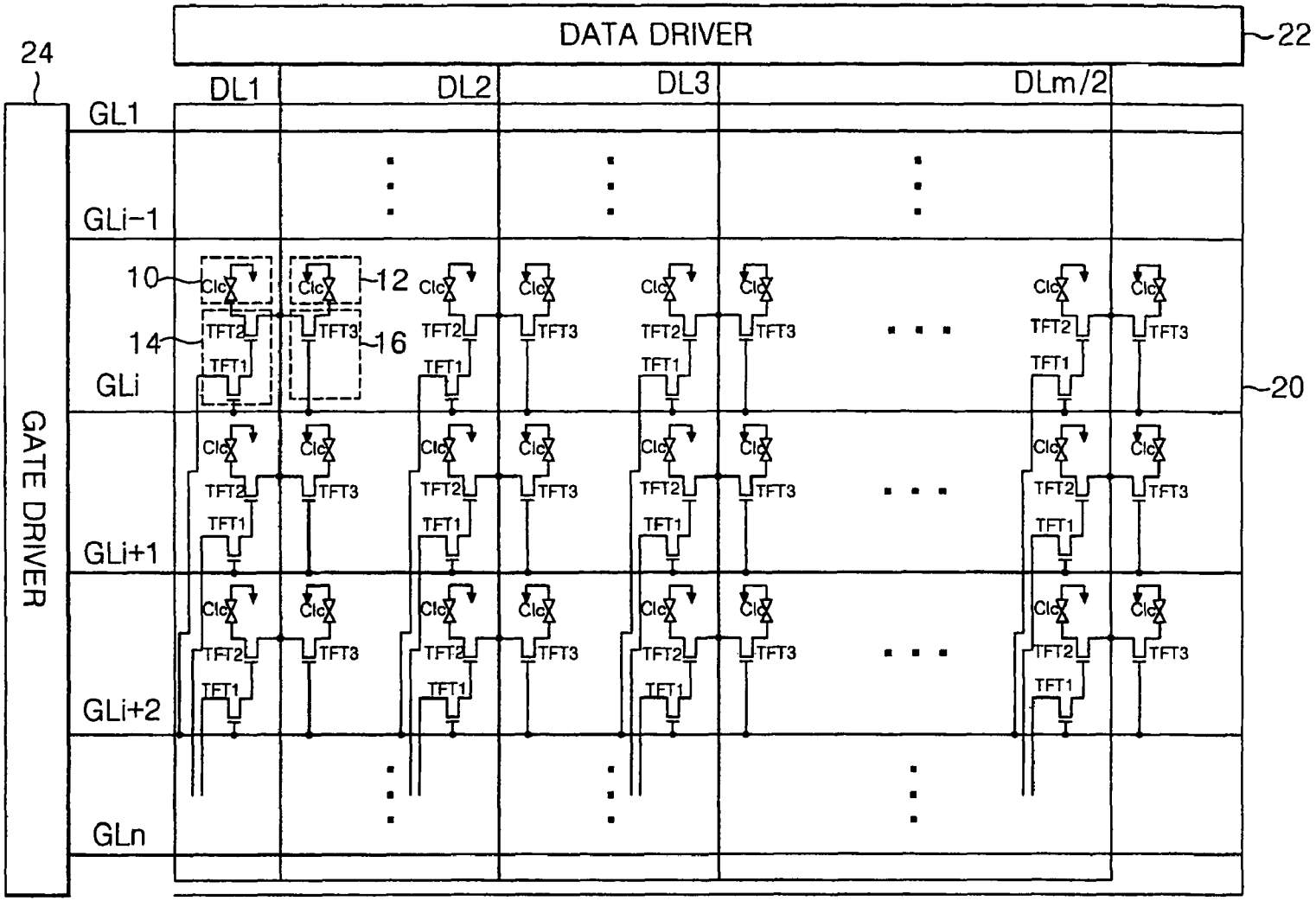
FIG. 2 illustrates a schematic view of a liquid crystal display device according to a first embodiment of the present invention.

FIG. 2 illustrates a schematic view for a liquid crystal display device according to a first embodiment of the present invention.

Referring to FIG. 2, the liquid crystal display device according to a first embodiment of the present invention includes a liquid crystal display panel 20, a data driver 22 driving data lines DL1 to DLm/2 of the liquid crystal display panel 20, and a gate driver 24 driving gate lines GL1 to GLn of the liquid crystal display panel 20.

More specifically, the liquid crystal display panel 20 includes first liquid crystal cells 10 and second liquid crystal cells 12 formed at the intersections of the gate lines GL1 to GLn and the data lines DL1 to DLm/2, a first switching part 14 formed in each of the first liquid crystal cells 10 and driving the first liquid crystal cells 10, and a second switching part 16 formed in each of the second liquid crystal cells 12 and driving the second liquid crystal cells 12. The first liquid crystal cells 10 and the second liquid crystal cells 12 are composed of a pixel electrode connected to the first switching part 14 and the second switching part 16 and a common electrode facing into each other and having liquid crystal therebetween, thus they can be expressed to be equivalent to a liquid crystal capacitor Clc. Herein, the first and second liquid crystal cells 10 and 12 include storage capacitors (not shown) connected to the previous gate line in order to sustain the data voltage charged in the liquid crystal capacitor Clc until the next data voltage is charged.

Figure 1:
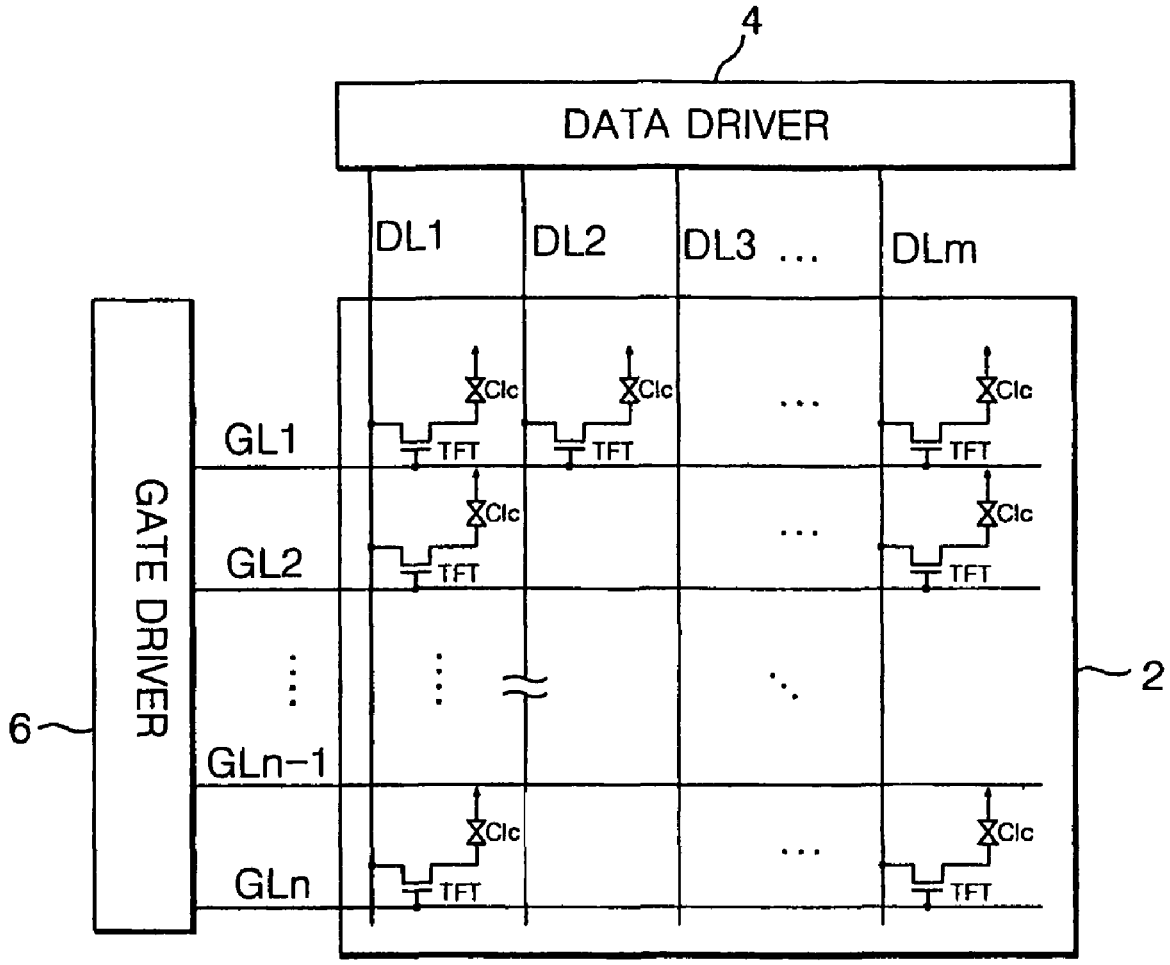
FIG. 1 RELATED ART
FIG. 1 illustrates a schematic view of a related art liquid crystal display device.

The first liquid crystal cells 10 and the first switching part 14 are formed on the left side of the data line DL (i.e., odd-numbered vertical lines). The second liquid crystal cells 12 and the second switching part 16 are formed on the right side of the data line DL (i.e., even-numbered vertical lines). In other words, the first liquid crystal cells 10 and the second liquid crystal cells 12 are formed on the left and right sides of a data line DL. At this point, the first liquid crystal cells 10 and the second liquid crystal cells 12 are supplied with video signals from the data line DL located adjacent thereto. In other words, in the liquid crystal display device according to the first embodiment of the present invention, the number of data lines DL are reduced to a half of that of the related art liquid crystal display device shown in FIG. 1.

Figure 4:
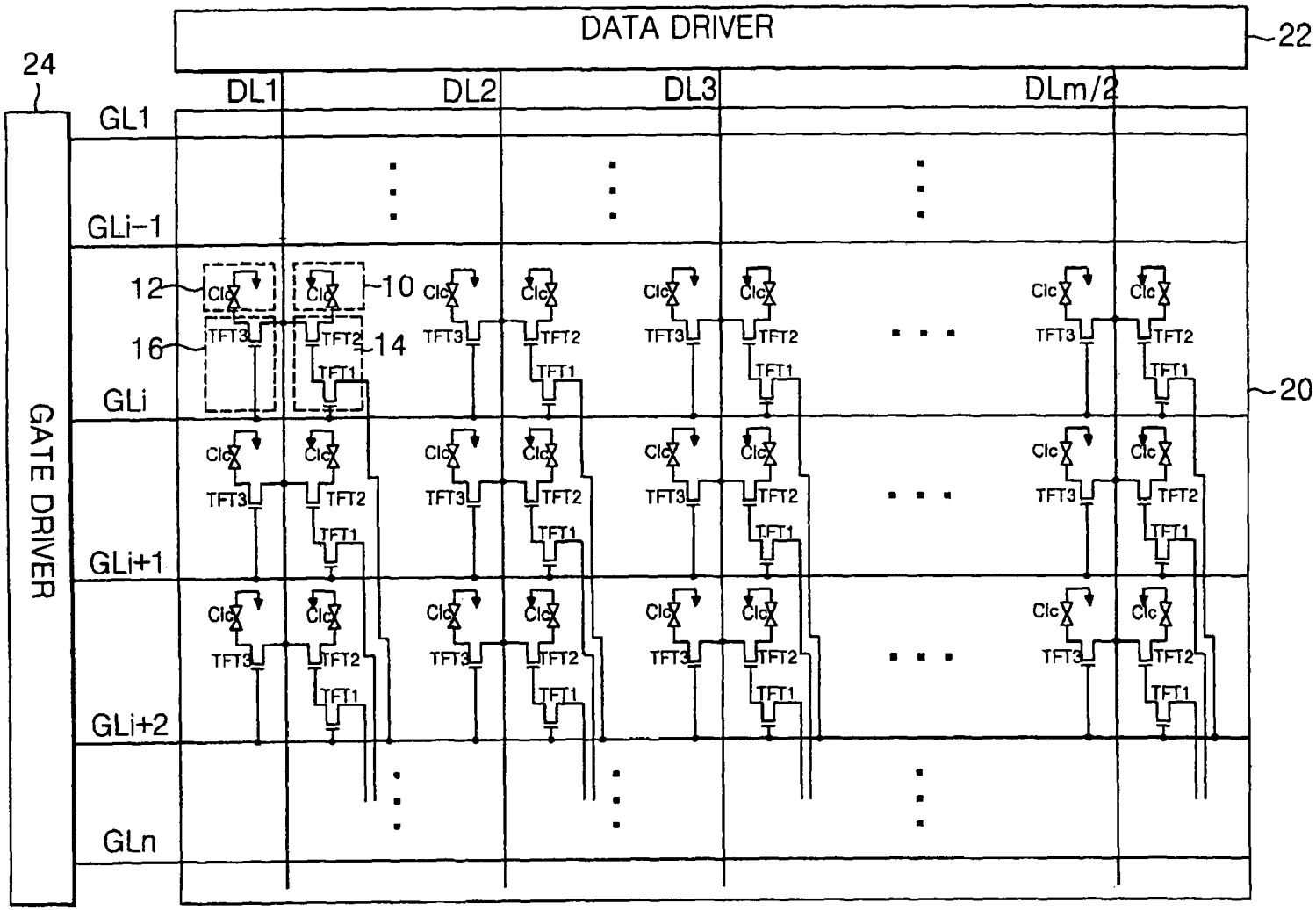
FIG. 4 illustrates a schematic view of a liquid crystal display device according to another embodiment of FIG. 2.

On the other hand, the location of the first liquid crystal cells 10 and the second liquid crystal cells 12 can be changed as shown in FIG. 4. More specifically, as shown in FIG. 4, the first liquid crystal cells 10 and the first switching part 14 are formed on the right side of the data line DL, and the second liquid crystal cells 12 and the second switching part 16 are formed on the left side of the data line DL. In other words, the first liquid crystal cells 10 and the first switching part 14 are formed in the even-numbered vertical lines, and the second liquid crystal cells 12 and the second switching part 16 are formed in the odd-numbered vertical lines.

The first switching part 14 that drives the first liquid crystal cells 10 located in the $i^{th}$ horizontal line includes a first thin film transistor TFT1 and a second thin film transistor TFT2 (wherein i is a natural number). The first thin film transistor TFT1 has its gate terminal connected to the $i^{th}$ gate line GLi and its source terminal connected to the $(i+2)^{th}$ gate line GLi+2. The second thin film transistor TFT2 has its gate terminal connected to the drain terminal of the first thin film transistor TFT1 and its source terminal connected to the adjacent data line DL. And, the drain terminal of the second thin film transistor TFT2 is connected to the first liquid crystal cells 10. In this way, the first switching part 14 applies a video signal to the first liquid crystal cells 10 when a driving signal is applied to the $i^{th}$ gate line GLi and the $(i+2)^{th}$ gate line GLi+2.

The second switching part 16 that drives the second liquid crystal cells 12 located in the $i^{th}$ horizontal line includes a third thin film transistor. The third thin film transistor TFT3 has its gate terminal connected to the $i^{th}$ gate line GLi and its source terminal connected to the adjacent data line. And, the drain terminal of the third thin film transistor TFT3 is connected to the second liquid crystal cells 12. In this way, the second switching part 16 applies a video signal to the second liquid crystal cells 12 when a driving signal is applied to the $i^{th}$ gate line GLi.

The data driver 22 converts data R, G, and B supplied from the timing controller into video signals as analog signals, which are then applied to the data lines DL1 to DLm/2. At this point, since the number of data lines DL1 to DLm/2 is decreased to a half of that of the related art liquid crystal display device shown in FIG. 1, the number of data driver IC's, which is included in the data driver 22, is also decreased to a half.

Figure 3:
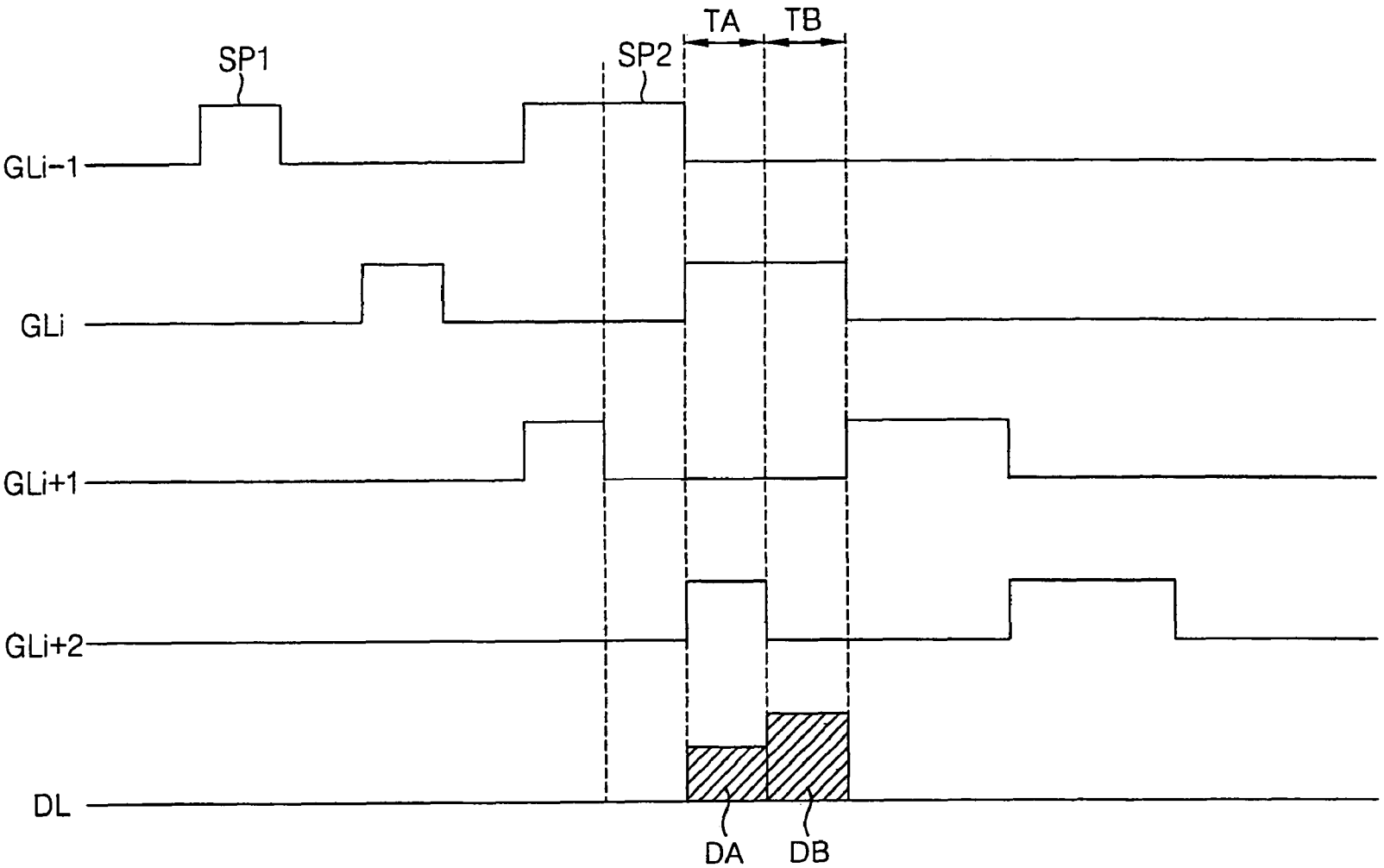
FIG. 3 is a waveform diagram illustrating gate signals applied to gate lines by a gate driver, as shown in FIG. 2.

As shown in FIG. 3, the gate driver 24 applies a first gate signal SP1 and a second gate signal SP2 to each of the gate lines GL1 to GLn in accordance with control signals applied from the timing controller (not shown). Herein, the width of the second gate signal SP2 is adjusted to be wider than that of the first gate signal SP1.

Meanwhile, the gate driver 24 applies the second gate signal SP2 supplied to the $i^{th}$ gate line GLi and the first gate signal SP1 supplied to the $(i+2)^{th}$ gate line GLi+2, so that the second gate signal SP2 overlap the first gate signal SP1 during a first period TA. At this point, since the width of the second gate signal SP2 is formed to be wider than that of the first gate signal SP1, the second gate signal SP2 does not overlap the first gate signal SP1 during a second period TB subsequent to the first period TA.

In other words, the second gate signal SP2 is applied to the $i^{th}$ gate line GLi, and at the same time, the first gate signal SP1 is applied to the $(i+2)^{th}$ gate line GLi+2. Accordingly, during the first period TA, the second gate signal SP2 applied to the $i^{th}$ gate line GLi overlaps the first gate signal SP1 applied to the $(i+2)^{th}$ gate line GLi+2. Then, during the second period TB subsequent to the first period TA, only the second gate signal SP2 is applied to the $i^{th}$ gate line GLi.

To describe in more detail a process of a video signal being applied to the liquid crystal cells 10 and 12 that are located in the $i^{th}$ horizontal line, during the first period TA, the second gate signal SP2 is applied to the $i^{th}$ gate line GLi, and at the same time, the first gate signal SP1 is applied to the $(i+2)^{th}$ gate line GLi+2. The first gate signal SP1 applied to the $(i+2)^{th}$ gate line GLi+2 is applied to the source terminal of the first thin film transistor TFT1. At this point, since the second gate signal SP2 applied to the $i^{th}$ gate line GLi turns on the first thin film transistor TFT1, the first gate signal SP1 applied to the source terminal of the first thin film transistor TFT1 is applied to the gate terminal of the second thin film transistor TFT2 to turn on the second thin film transistor TFT2. When the second thin film transistor TFT2 is turned on, a first video signal DA applied to the data line DL is applied to the first liquid crystal cells 10 through the second thin film transistor TFT2.

Subsequently, the third thin film transistor TFT3 is turned on during the second period TB, when only the second gate signal SP2 is applied to the $i^{th}$ gate line GLi. When the third thin film transistor TFT3 is turned on, the second video signal DB applied to the data line DL is applied to the second liquid crystal cells 12 through the third thin film transistor TFT3.

On the other hand, since the second liquid crystal cells 12 substantially receive the second gate signal SP2 during the first period TA, the second liquid crystal cells 12 are charged with the first video signal DA during the first period TA. However, during the second period TB subsequent to the first period TA, since the second video signal DB is applied, the second liquid crystal cells 12 can be charged with a desired video signal DB.

Figure 5:
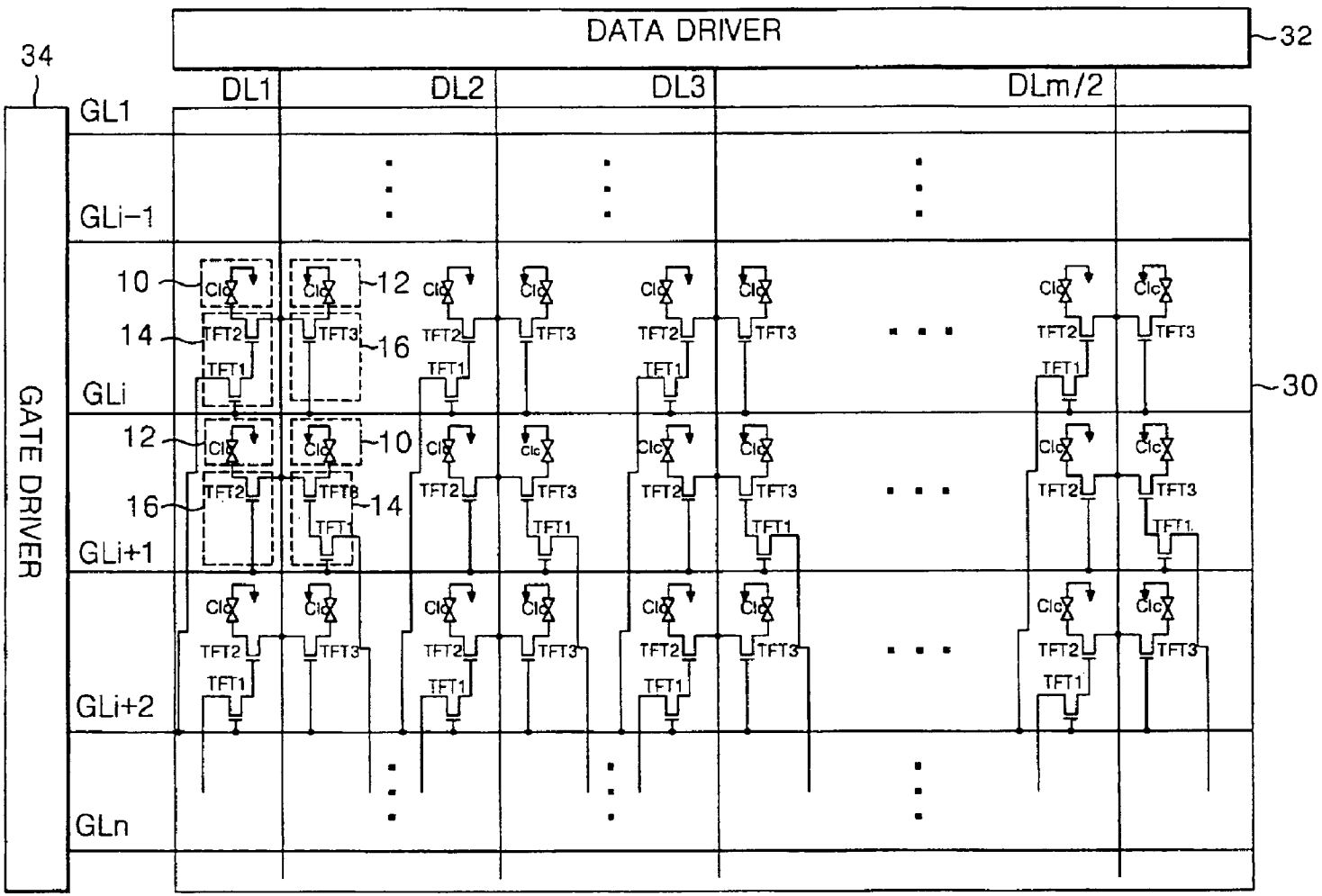
FIG. 5 illustrates a schematic view of a liquid crystal display device according to a second embodiment of the present invention.

FIG. 5 illustrates a schematic view of a liquid crystal display device according to a second embodiment of the present invention. In this embodiment, the location of the liquid crystal cells 10 and 12 and the switching parts 14 and 16 is changed, and their structures and functions are similar to those of the first embodiment of the present invention in FIG. 2.

Referring to FIG. 5, the liquid crystal display device according to the second embodiment of the present invention includes a liquid crystal display panel 30, a data driver 32 driving data lines DL1 to DLm/2 of the liquid crystal display panel 30, and a gate driver 34 driving gate lines GL1 to GLn of the liquid crystal display panel 30.

The liquid crystal display panel 30 includes first liquid crystal cells 10 and second liquid crystal cells 12 formed at each intersection of the gate lines GL1 to GLn and the data lines DL1 to DLm/2, first switching parts 14 driving the first liquid crystal cells 10, and second switching parts 16 driving the second liquid crystal cells 12. In the second embodiment of the present invention, the first liquid crystal cells 10 and the first switching part 14 and the second liquid crystal cells 12 and the second switching part 16 are alternately arranged with respect to the data lines DL.

Herein, as shown in FIG. 5, in the odd-numbered horizontal lines, the first liquid crystal cells 10 and the first switching part 14 are located in the odd-numbered vertical lines, and the second liquid crystal cells 12 and the second switching part 16 are located in the even-numbered vertical lines. And, in the even-numbered horizontal lines, the first liquid crystal cells 10 and the first switching part 14 are located in the even-numbered vertical lines, and the second liquid crystal cells 12 and the second switching part 16 are located in the odd-numbered vertical lines.

Figure 6:
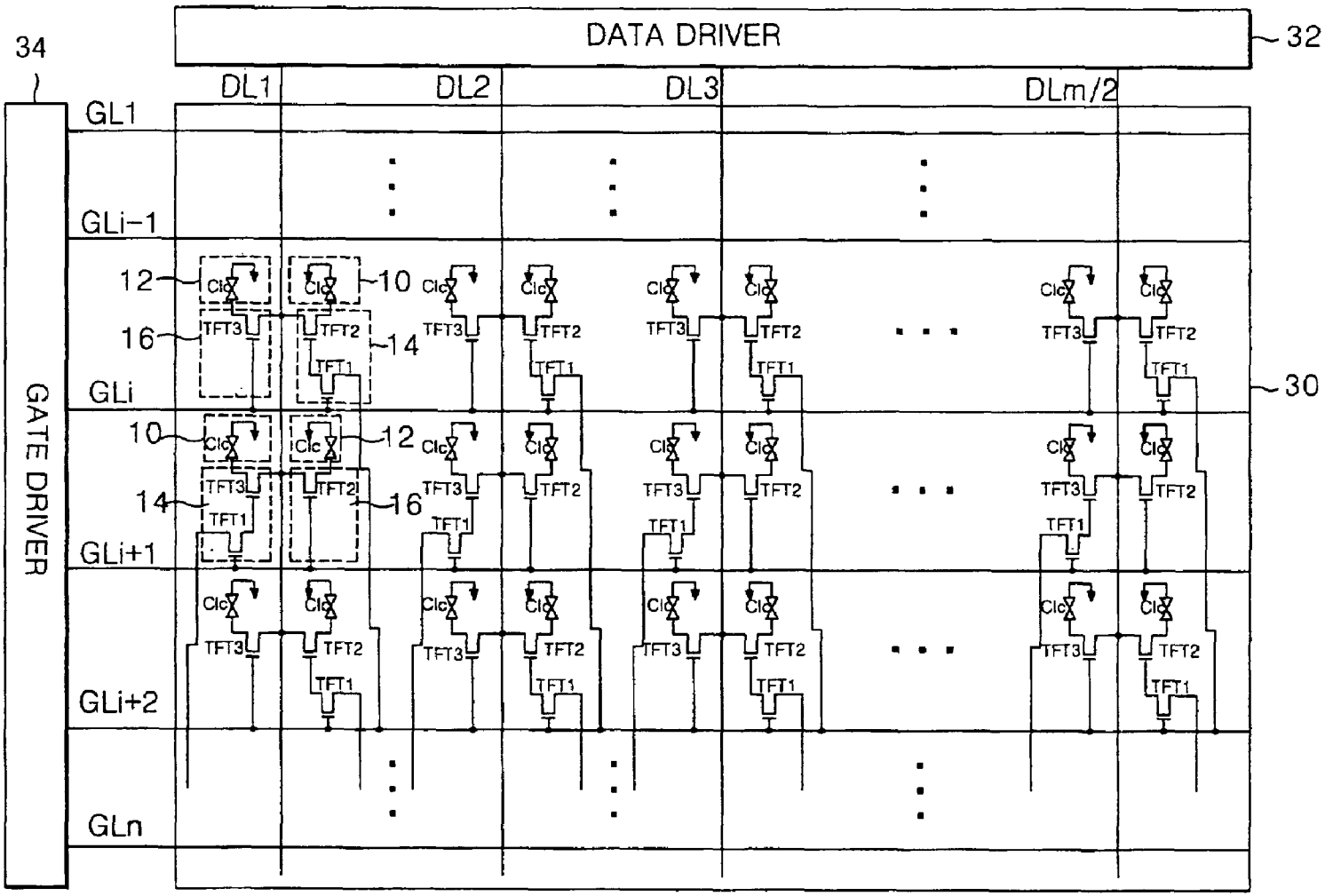
FIG. 6 illustrates a schematic view of a liquid crystal display device according to another embodiment of FIG. 5.

Further, in the second embodiment of the present invention, in the odd-numbered horizontal lines, as shown in FIG. 6, the first liquid crystal cells 10 and the first switching part 14 are located in the even-numbered vertical lines, and the second liquid crystal cells 12 and the second switching part 16 are located in the odd-numbered vertical lines. And, in the even-numbered horizontal lines, the first liquid crystal cells 10 and the first switching part 14 are located in the odd-numbered vertical lines, and the second liquid crystal cells 12 and the second switching part 16 are located in the even-numbered vertical lines.

In this way, the first liquid crystal cells 10 and the second liquid crystal cells 12 alternately arranged with respect to the data lines DL receive the video signal from the adjacent data lines DL (i.e., the base data line). Therefore, in the liquid crystal display device according to the second embodiment of the present invention, the number of data lines DL is reduced to a half of that in the related art liquid crystal display device shown in FIG. 1.

The first switching part 14 that drives the first liquid crystal cells 10 located in the $i^{th}$ horizontal lines includes a first thin film transistor TFT1 and a second thin film transistor TFT 2 (wherein i is a natural number). The first thin film transistor TFT1 has its gate terminal connected to the $i^{th}$ gate line GLi and its source terminal connected to the $(i+2)^{th}$ gate line GLi+2. The second thin film transistor TFT2 has its gate terminal connected to the drain terminal of the first thin film transistor TFT1 and its source terminal connected to the adjacent data line DL. And, the drain terminal of the second thin film transistor TFT2 is connected to the first liquid crystal cells 10. In this way, the first switching part 14 applies a video signal to the first liquid crystal cells 10, when a driving signal is applied to the $i^{th}$ gate line GLi and the $(i+2)^{th}$ gate line GLi+2.

The second switching part 16 that drives the second liquid crystal cells 12 located in the $i^{th}$ horizontal line includes a third thin film transistor TFT3. The third thin film transistor TFT3 has its gate terminal connected to the $i^{th}$ gate line GLi and its source terminal connected to the adjacent data line. And, the drain terminal of the third thin film transistor TFT3 is connected to the second liquid crystal cells 12. In this way, the second switching part 16 applies a video signal to the second liquid crystal cells 12 when a driving signal is applied to the $i^{th}$ gate line GLi.

The data driver 32 converts data R, G, and B supplied from the timing controller into video signals as analog signals, which are then applied to the data lines DL1 to DLm/2. At this point, since the number of data lines DL1 to DLm/2 is decreased to a half of that of the related art liquid crystal display device shown in FIG. 1, the number of data driver IC's, which is included in the data driver 32, is also decreased to a half.

As shown in FIG. 3, the gate driver 34 applies a first gate signal SP1 and a second gate signal SP2 to each of the gate lines GL1 to GLn in accordance with control signals applied from the timing controller (not shown). Herein, the width of the second gate signal SP2 is adjusted to be wider than that of the first gate signal SP1.

On the other hand, the gate driver 34 applies the second gate signal SP2 supplied to the $i^{th}$ gate line GLi and the first gate signal SP1 supplied to the $(i+2)^{th}$ gate line GLi+2, so that the second gate signal SP2 overlaps the first gate signal SP1 during a first period TA. At this point, since the width of the second gate signal SP2 is formed to be wider than that of the first gate signal SP1, the second gate signal SP2 does not overlap the first gate signal SP1 during a second period TB subsequent to the first period TA.

In other words, the second gate signal SP2 is applied to the $i^{th}$ gate line GLi, and at the same time, the first gate signal SP1 is applied to the $(i+2)^{th}$ gate line GLi+2. Accordingly, during the first period TA, the second gate signal SP2 applied to the $i^{th}$ gate line GLi overlaps the first gate signal SP1 applied to the $(i+2)^{th}$ gate line GLi+2. Then, during the second period TB subsequent to the first period TA, only the second gate signal SP2 is applied to the $i^{th}$ gate line GLi.

To describe in more detail a process of a video signal being applied to the first and second liquid crystal cells 10 and 12 that are located in the $i^{th}$ horizontal line, during the first period TA, the second gate signal SP2 is applied to the $i^{th}$ gate line GLi, and at the same time, the first gate signal SP1 is applied to the $(i+2)^{th}$ gate line GLi+2. The first gate signal SP1 applied to the $(i+2)^{th}$ gate line GLi is applied to the source terminal of the first thin film transistor TFT1. At this point, since the first thin film transistor TFT1 is turned on by the second gate signal SP2 applied to the $i^{th}$ gate line GLi, the first gate signal SP1 applied to the source terminal of the first thin film transistor TFT1 is applied to the gate terminal of the second thin film transistor TFT2 to turn on the second thin film transistor TFT2. When the second thin film transistor TFT2 is turned on, a first video signal DA applied to the data line DL is applied to the first liquid crystal cells 10 through the second thin film transistor TFT2.

Subsequently, the third thin film transistor TFT3 is turned on during the second period TB, when only the second gate signal SP2 is applied to the $i^{th}$ gate line GLi. When the third thin film transistor TFT3 is turned on, the second video signal DB applied to the data line DL is applied to the second liquid crystal cells 12 through the third thin film transistor TFT3.

Meanwhile, in the second embodiment of the present invention, since the first liquid crystal cells 10 and the second liquid crystal cells 12 are alternately arranged, a uniform image can be displayed, even though the first liquid crystal cells 10 and the second liquid crystal cells 12 are not charged with a uniform voltage. For example, although the first liquid crystal cells 10 are charged with a voltage higher than a desired voltage and the second liquid crystal cells 12 are charged with a voltage lower than the desired voltage, due to the alternate arrangement of the first liquid crystal cells 10 and the second liquid crystal cells 12, the voltage difference is set off by a horizontal line unit, thereby displaying a uniform image.

Figure 7:
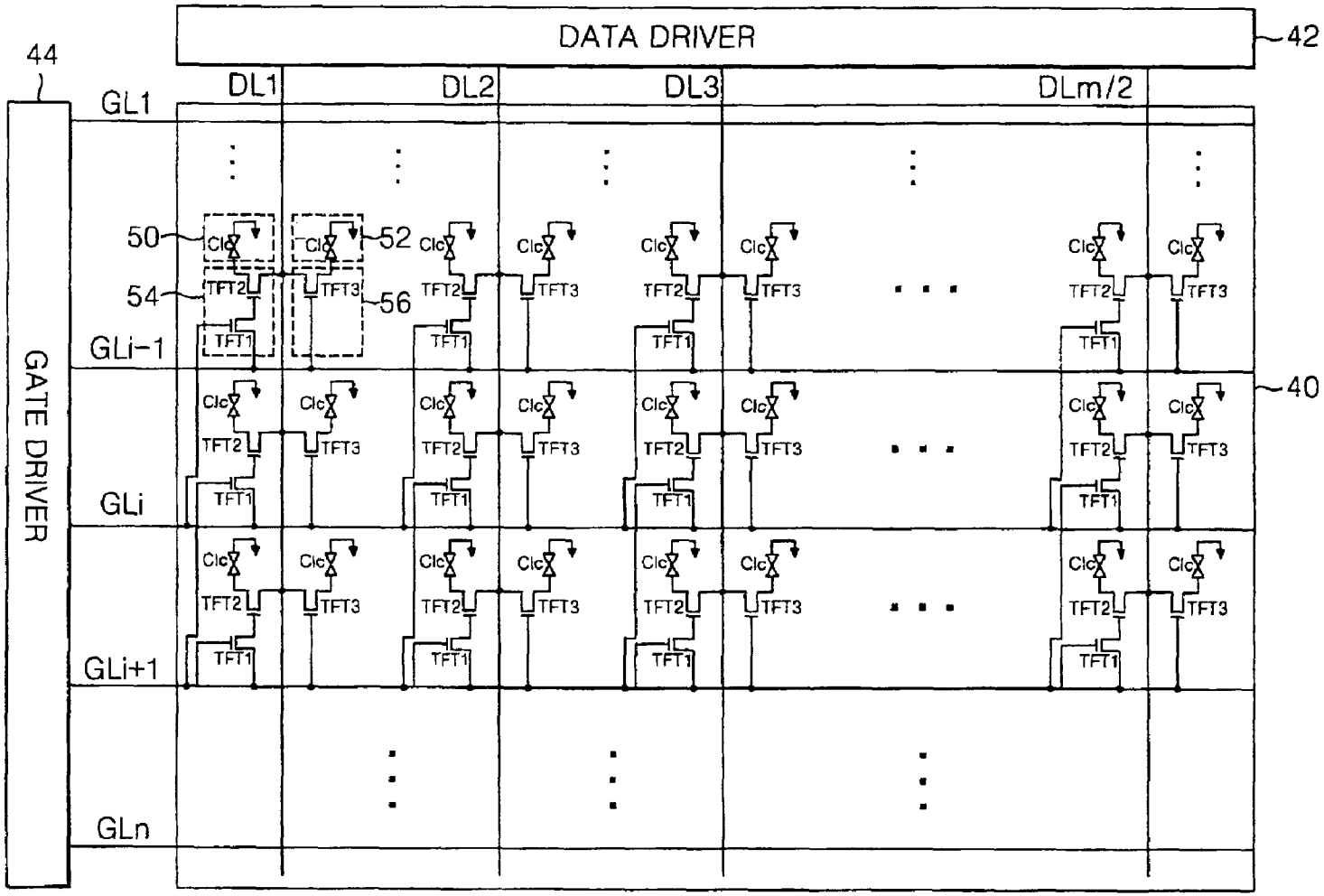
FIG. 7 illustrates a schematic view of a liquid crystal display device according to a third embodiment of the present invention.

FIG. 7 illustrates a schematic view of a liquid crystal display device according to a third embodiment of the present invention.

Referring to FIG. 7, the liquid crystal display device according to a third embodiment of the present invention includes a liquid crystal display panel 40, a data driver 42 driving data lines DL1 to DLm/2 of the liquid crystal display panel 40, and a gate driver 44 driving gate lines GL1 to GLn of the liquid crystal display panel 40.

The liquid crystal display panel 40 includes first liquid crystal cells 50 and second liquid crystal cells 52 formed at the intersections of the gate lines GL1 to GLn and the data lines DL1 to DLm/2, a first switching part 54 formed in each of the first liquid crystal cells 50 and driving the first liquid crystal cells 50, and a second switching part 56 formed in each of the second liquid crystal cells 52 and driving the second liquid crystal cells 52. The first liquid crystal cells 50 and the second liquid crystal cells 52 are composed of a pixel electrode connected to the first switching part 14 and the second switching part 16 and a common electrode facing into each other and having liquid crystal therebetween. Therefore, the first and second liquid crystal cells can be expressed to be equivalent to a liquid crystal capacitor Clc. Herein, the first and second liquid crystal cells 50 and 52 include storage capacitors (not shown) connected to the previous gate line in order to sustain the data voltage charged in the liquid crystal capacitor Clc until the next data voltage is charged.

The first liquid crystal cells 50 and the first switching part 54 are formed on the left side of the data lines DL (i.e., odd-numbered vertical lines). The second liquid crystal cells 52 and the second switching part 56 are formed on the right side of the data lines DL (i.e., even-numbered vertical lines). In other words, the first liquid crystal cells 50 and the second liquid crystal cells 52 are formed on the left and right sides of one data line DL. At this moment, the first liquid crystal cells 50 and the second liquid crystal cells 52 are supplied with video signals from the data lines DL located adjacent thereto. In other words, in the liquid crystal display device according to the third embodiment of the present invention, the number of data lines DL is reduced to a half of that of the related art liquid crystal display device shown in FIG. 1.

Figure 9:
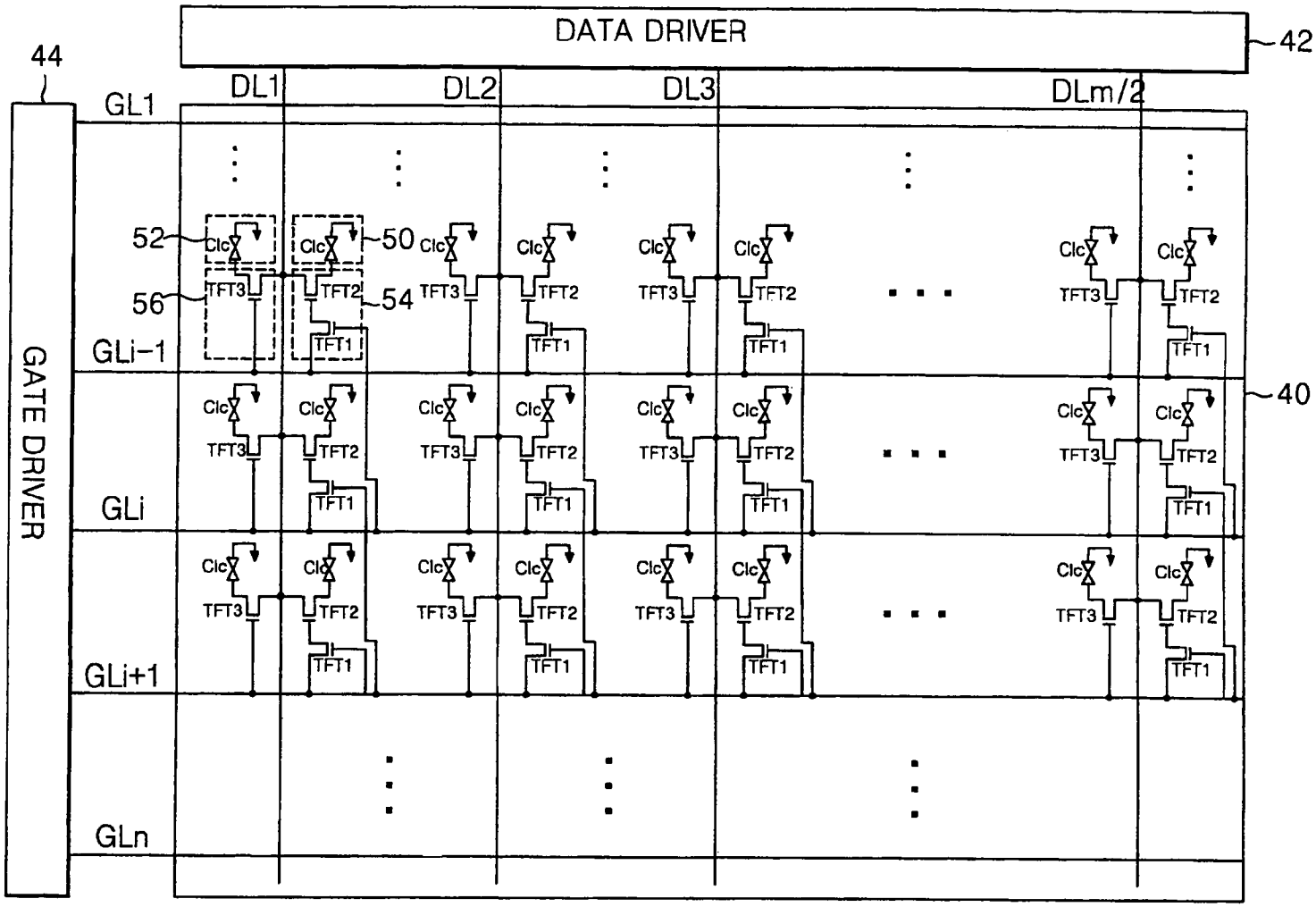
FIG. 9 illustrates a schematic view of a liquid crystal display device according to another embodiment of FIG. 7.

On the other hand, the location of the first liquid crystal cells 50 and the second liquid crystal cells 52 can be changed as in shown FIG. 9 in the present invention. More specifically, as shown in FIG. 9, the first liquid crystal cells 50 and the first switching part 54 are formed on the right side of the data lines DL, and the second liquid crystal cells 52 and the second switching part 56 are formed on the left side of the data lines DL. In other words, the first liquid crystal cells 50 and the first switching part 54 are formed in the even-numbered vertical lines, and the second liquid crystal cells 52 and the second switching part 56 are formed in the odd-numbered vertical lines.

The first switching part 54 that drives the first liquid crystal cells 50 located in the $i^{th}$ horizontal line includes a first thin film transistor TFT1 and a second thin film transistor TFT2 (wherein i is a natural number). The first thin film transistor TFT1 has its source terminal connected to the $i^{th}$ gate line GLi and its gate-terminal connected to the $(i+1)^{th}$ gate line GLi+1. The second thin film transistor TFT2 has its gate terminal connected to the drain terminal of the first thin film transistor TFT1 and its source terminal connected to the adjacent data line DL. And, the drain terminal of the second thin film transistor TFT2 is connected to the first liquid crystal cells 50. In this way, the first switching part 54 applies a video signal to the first liquid crystal cells 50 when a driving signal is applied to the $i^{th}$ gate line GLi and the $(i+1)^{th}$ gate line GLi+1.

The second switching part 56 that drives the second liquid crystal cells 52 located in the $i^{th}$ horizontal line includes a third thin film transistor TFT3. The third thin film transistor TFT3 has its gate terminal connected to the $i^{th}$ gate line GLi and its source terminal connected to the adjacent data line. And, the drain terminal of the third thin film transistor TFT3 is connected to the second liquid crystal cells 52. In this way, the second switching part 56 applies a video signal to the second liquid crystal cells 52 when a driving signal is applied to the $i^{th}$ gate line GLi.

The data driver 42 converts data R, G, and B supplied from the timing controller into video signals as analog signals, which are then applied to the data lines DL1 to DLm/2. At this moment, since the number of data lines DL1 to DLm/2 is decreased to a half of that of the related art liquid crystal display device shown in FIG. 1, the number of data driver IC's, which is included in the data driver 42, is also decreased to a half.

Figure 8:
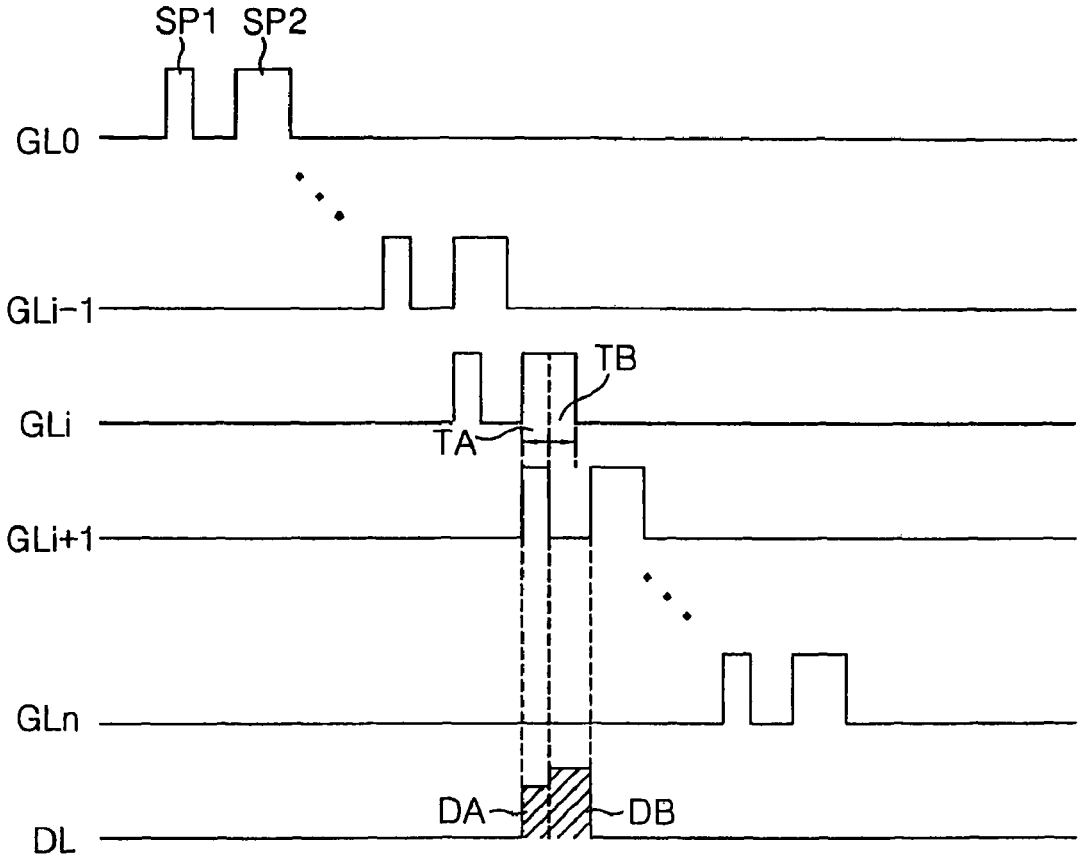
FIG. 8 is a waveform diagram illustrating gate signals applied to gate lines by a gate driver, as shown in FIG. 7.

As shown in FIG. 8, the gate driver 44 applies a first gate signal SP1 and a second gate signal SP2 to each of the gate lines GL1 to GLn in accordance with control signals applied from the timing controller (not shown). Herein, the width of the second gate signal SP2 is adjusted to be wider than that of the first gate signal SP1.

On the other hand, the gate driver 44 applies the second gate signal SP2 supplied to the $i^{th}$ gate line GLi and the first gate signal SP1 supplied to the $(i+1)^{th}$ gate line GLi+1, so that the second gate signal SP2 overlaps the first gate signal SP1 during a first period TA. At this point, since the width of the second gate signal SP2 is formed to be wider than that of the first gate signal SP1, the second gate signal SP2 does not overlap the first gate signal SP1 during a second period TB subsequent to the first period TA.

In other words, during the first period TA, the second gate signal SP2 is applied to the $i^{th}$ gate line GLi, and at the same time, the first gate signal SP1 is applied to the $(i+1)^{th}$ gate line GLi+1. Then, only the second gate signal SP2 is applied to the $i^{th}$ gate line GLi during the second period TB subsequent to the first period TA.

To describe in more detail a process of a video signal being applied to the liquid crystal cells 50 and 52 that are located in the $i^{th}$ horizontal line, during the first period TA, the second gate signal SP2 is applied to the $i^{th}$ gate line GLi, and at the same time, the first gate signal SP1 is applied to the $(i+1)^{th}$ gate line GLi+1. The first gate signal SP1 applied to the $(i+1)^{th}$ gate line GLi+1 is applied to the gate terminal of the first thin film transistor TFT1, thereby turning on the first thin film transistor TFT1. Accordingly, the second gate signal SP2 applied to the $i^{th}$ gate line GLi is applied to the gate terminal of the second thin film transistor TFT2 through the first thin film transistor TFT1, thus the second thin film transistor TFT2 is turned on. When the second thin film transistor TFT2 is turned on, a first video signal DA applied to the data line DL is applied to the first liquid crystal cells 50 through the second thin film transistor TFT2.

Subsequently, the third thin film transistor TFT3 is turned on during the second period TB, when only the second gate signal SP2 is applied to the $i^{th}$ gate line GLi. When the third thin film transistor TFT3 is turned on, the second video signal DB applied to the data line DL is applied to the second liquid crystal cells 52 through the third thin film transistor TFT3.

On the other hand, since the second liquid crystal cells 52 substantially receive the second gate signal SP2 during the first period TA, the second liquid crystal cells 52 are charged with the first video signal DA during the first period TA. However, during the second period TB subsequent to the first period TA, since the second video signal DB is applied, the second liquid crystal cells 52 can be charged with a desired video signal DB.

Figure 10:
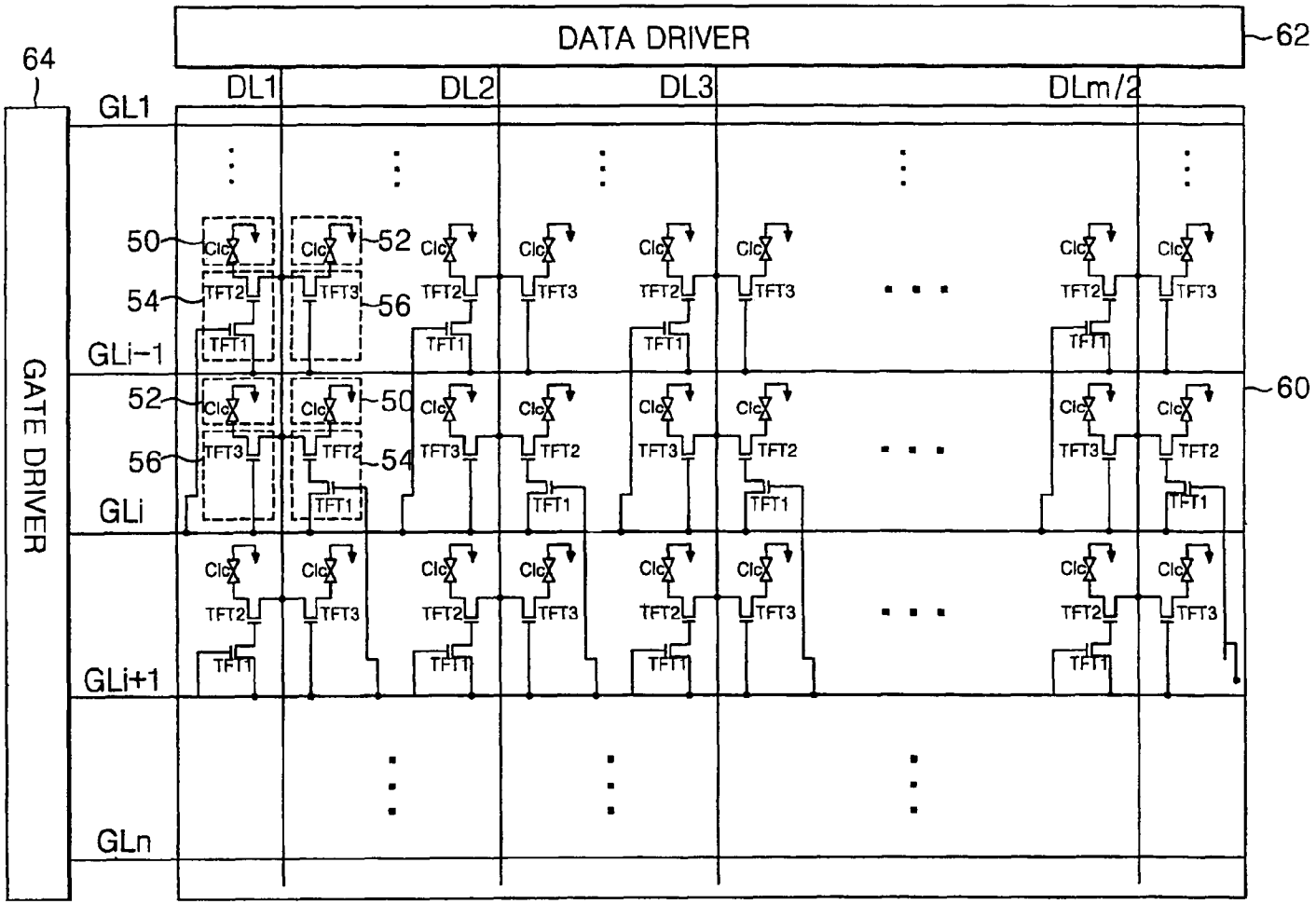
FIG. 10 illustrates a schematic view of a liquid crystal display device according to a fourth embodiment of the present invention.

FIG. 10 illustrates a schematic view of a liquid crystal display device according to a fourth embodiment of the present invention. In this embodiment, the location where the liquid crystal cells 50 and 52 and the switching parts 54 and 56 are formed is changed, and their structures and functions are similar to those of the third embodiment of the present invention shown in FIG. 7.

Referring to FIG. 10, the liquid crystal display device according to a fourth embodiment of the present invention includes a liquid crystal display panel 60, a data driver 62 driving data lines DL1 to DLm/2 of the liquid crystal display panel 60, and a gate driver 64 driving gate lines GL1 to GLn of the liquid crystal display panel 60.

The liquid crystal display panel 60 includes first liquid crystal cells 50 and second liquid crystal cells 52 formed at each intersection of the gate lines GL1 to GLn and the data lines DL1 to DLm/2, a plurality of first switching parts 54 driving the first liquid crystal cells 50 and a plurality of second switching parts 56 driving the second liquid crystal cells 52. In the fourth embodiment of the present invention, the first liquid crystal cells 50 and switching part 54 and the second liquid crystal cells 52 and switching part 56 are alternately arranged with respect to the data lines DL.

Herein, in the odd-numbered horizontal lines, the first liquid crystal cells 50 and the first switching part 54, as shown in FIG. 10, are located in the odd-numbered vertical lines, and the second liquid crystal cells 52 and the second switching part 56 are located in the even-numbered vertical lines. And, in the even-numbered horizontal lines, the first liquid crystal cells 50 and the first switching part 54 are located in the even-numbered vertical lines, and the second liquid crystal cells 52 and the second switching part 56 are located in the odd-numbered vertical lines.

Figure 11:
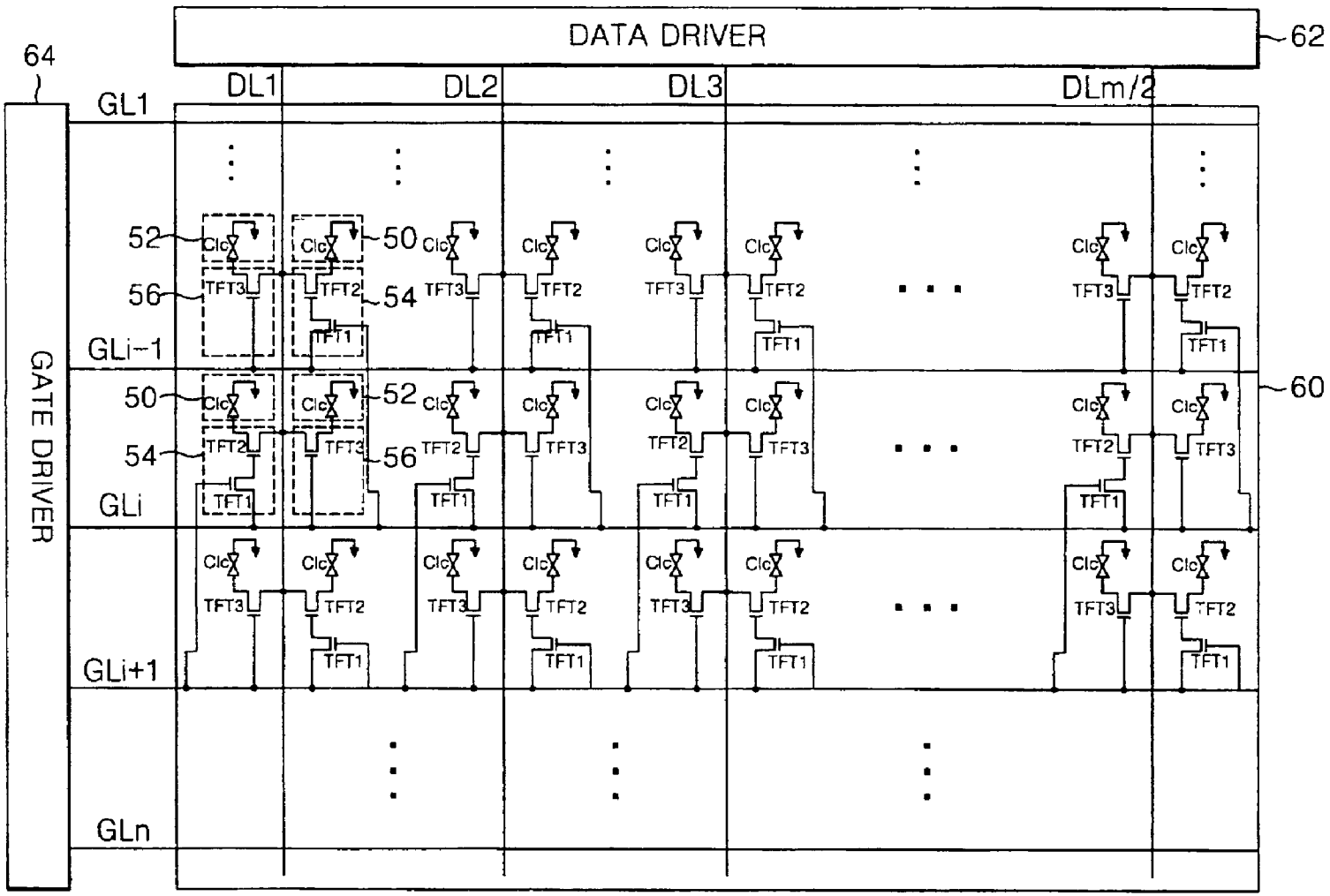
FIG. 11 illustrates a schematic view of a liquid crystal display device according to another embodiment of FIG. 10.

Further, in the present invention, in the odd-numbered horizontal lines shown in FIG. 11, the first liquid crystal cells 50 and the first switching part 54 are located in the even-numbered vertical lines, and the second liquid crystal cells 52 and the second switching part 56 are located in the odd-numbered vertical lines. At this point, in the even-numbered horizontal lines, the first liquid crystal cells 50 and the first switching part 54 are located in the odd-numbered vertical lines, and the second liquid crystal cells 52 and the second switching part 56 are located in the even-numbered vertical lines.

In this way, the first liquid crystal cells 50 and the second liquid crystal cells 52 having an alternate arrangement with respect to the data lines DL receive the video signal from the adjacent data lines DL (i.e., the base data line). Therefore, in the liquid crystal display device according to the fourth embodiment of the present invention, the number of data lines DL is reduced to a half of that of the related art liquid crystal display device shown in FIG. 1.

The first switching part 54 that drives the first liquid crystal cell 50 located in the $i^{th}$ horizontal line includes a first thin film transistor TFT1 and a second thin film transistor TFT2 (wherein i is a natural number). The first thin film transistor TFT1 has its source terminal connected to the $i^{th}$ gate line GLi and its gate terminal connected to the $(i+1)^{th}$ gate line GLi+1. The second thin film transistor TFT2 has its gate terminal connected to the drain terminal of the first thin film transistor TFT1 and its source terminal connected to the adjacent data line DL. And, the drain terminal of the second thin film transistor TFT2 is connected to the first liquid crystal cells 50. The first switching part 54 applies a video signal to the first liquid crystal cells 50 when a driving signal is applied to the $i^{th}$ gate line GLi and the $(i+1)^{th}$ gate line GLi+1.

The second switching part 56 that drives the second liquid crystal cells 52 located in the $i^{th}$ horizontal line includes a third thin film transistor TFT3. The third thin film transistor TFT3 has its gate terminal connected to the $i^{th}$ gate line GLi and its source terminal connected to the adjacent data line DL. And, the drain terminal of the third thin film transistor TFT3 is connected to the second liquid crystal cells 52. In this way, the second switching part 56 applies a video signal to the second liquid crystal cells 52 when a driving signal is applied to the $i^{th}$ gate line GLi.

The data driver 62 converts data R, G, and B supplied from the timing controller into video signals as analog signals, which are then applied to the data lines DL1 to DLm/2. At this point, since the number of data lines DL1 to DLm/2 is decreased to a half of that of the related art liquid crystal display device shown in FIG. 1, the number of data driver IC's, which is included in the data driver 62, is also decreased to a half.

As shown in FIG. 8, the gate driver 64 applies a first gate signal SP1 and a second gate signal SP2 to each of the gate lines GL1 to GLn in accordance with control signals applied from the timing controller (not shown). Herein, the width of the second gate signal SP2 is adjusted to be wider than that of the first gate signal SP1.

On the other hand, the gate driver 64 applies the second gate signal SP2 supplied to the $i^{th}$ gate line GLi and the first gate signal SP1 supplied to the $(i+1)^{th}$ gate line GLi+1, so that the second gate signal SP2 overlaps the first gate signal SP1 during a first period TA. At this point, since the width of the second gate signal SP2 is formed to be wider than that of the first gate signal SP1, the second gate signal SP2 does not overlap the first gate signal SP1 during a second period TB subsequent to the first period TA.

In other words, for the first period TA, the second gate signal SP2 is applied to the $i^{th}$ gate line GLi, and at the same time, the first gate signal SP1 is applied to the $(i+1)^{th}$ gate line GLi+1. Then, only the second gate signal SP2 is applied to the $i^{th}$ gate line GLi during the second period TB subsequent to the first period TA.

To describe in more detail a process of a video signal being applied to the liquid crystal cells 50 and 52 that are located in the $i^{th}$ horizontal line, during the first period TA, the second gate signal SP2 is applied to the $i^{th}$ gate line GLi, and at the same time, the first gate signal SP1 is applied to the $(i+1)^{th}$ gate line GLi+1. The first gate signal SP1 applied to the $(i+1)^{th}$ gate line GLi+1 is applied to the gate terminal of the first thin film transistor TFT1, thereby turning on the first thin film transistor TFT1. Accordingly, the second gate signal SP2 applied to the $i^{th}$ gate line GLi is applied to the gate terminal of the second thin film transistor TFT2 through the first thin film transistor TFT1, thus the second thin film transistor TFT2 is turned on. When the second thin film transistor TFT2 is turned on, a first video signal DA applied to the data line DL is applied to the first liquid crystal cells 50 through the second thin film transistor TFT2.

Subsequently, the third thin film transistor TFT3 is turned on during the second period TB when only the second gate signal SP2 is applied to the $i^{th}$ gate line GLi. When the third thin film transistor TFT3 is turned on, the second video signal DB applied to the data lines DL is applied to the second liquid crystal cells 52 through the third thin film transistor TFT3.

On the other hand, in the fourth embodiment of the present invention, due to an alternate arrangement of the first liquid crystal cells 50 and the second liquid crystal cells 52, even though the first liquid crystal cells 50 and the second liquid crystal cells 52 are not charged with an equal voltage, a uniform image can be displayed. For example, although the first liquid crystal cells 50 are charged with a voltage higher than a desired voltage and the second liquid crystal cells 52 are charged with a voltage lower than the desired voltage, because the first liquid crystal cells 50 and the second liquid crystal cells 52 are arranged in an alternate form, the voltage difference is set off by the horizontal line unit, thereby displaying a uniform image.

Figure 12:
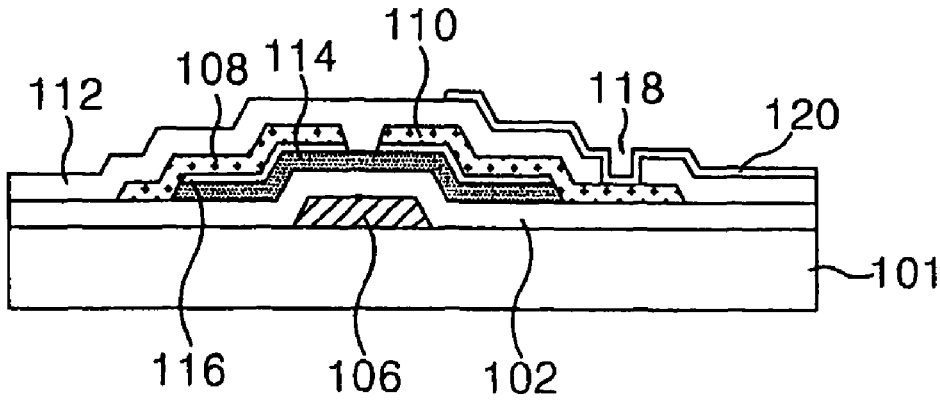
FIG. 12 is a cross-sectional view illustrating a structure of the thin film transistor of the present invention.

A cross-sectional view illustrating a structure of each of thin film transistors TFT of the present invention is shown in FIG. 12.

Referring to FIG. 12, a thin film transistor TFT includes a gate electrode 106 formed on a lower substrate 101, a source electrode 108 and a drain electrode 110 formed in a layer different from that of the gate electrode 106. Herein, the drain electrode 110 is formed to contact a pixel electrode 120 through a drain contact hole 118. The drain electrode 110 is contacted to the pixel electrode 120 or the adjacent thin film transistor TFT.

An active layer 114 and an ohmic contact layer 116 are deposited to form a conduction channel between the gate electrode 106, the source electrode 108 and the drain electrode 110. Herein, the active layer 114 and the ohmic contact layer 116 are collectively called a semiconductor layer. The ohmic layer 116 is formed between the active layer 114 and the source electrode 108, and between the active layer 114 and the drain electrode 110. The active layer 114 is formed of the amorphous silicon, and not doped with impurities. The ohmic contact layer 116 is formed of the amorphous silicon, and doped with impurities of n-type or p-type. The semiconductor layer 114 and 116 apply a voltage supplied to the source electrode 108 to the drain electrode 110, when the voltage is applied to the gate electrode 106. A gate insulating layer 112 is formed between the gate electrode 106 and the semiconductor layer 114 and 116. A protective layer 112 is formed on the source electrode 108 and the drain electrode 110.

The source electrode 108 and the drain electrode 110 of the thin film transistor TFT included in the embodiments of the present invention are each formed of a mask different from those of the semiconductor layer 114 and 116. Accordingly, each of the source electrode 108 and the drain electrode 110 has a pattern different from those in the semiconductor layer 114 and 116.

Figure 13:
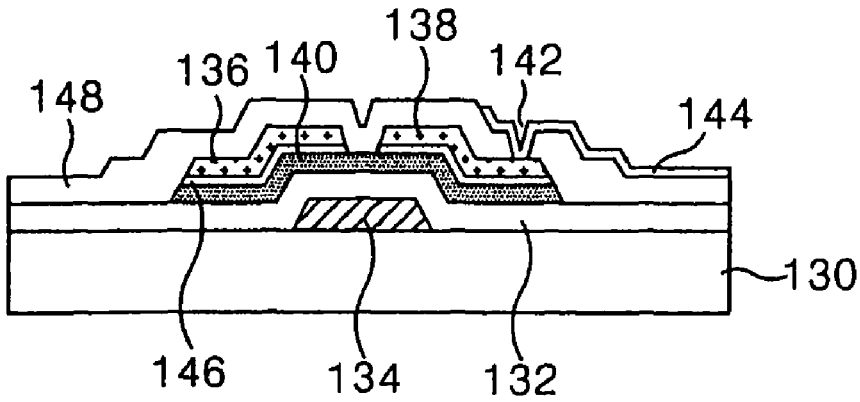
FIG. 13 is a cross-sectional view illustrating another structure of the thin film transistor of the present invention.

FIG. 13 is a cross-sectional view illustrating another structure of the thin film transistor of the present invention.

Referring to FIG. 13, the thin film transistor TFT of the present invention includes a gate electrode 134 formed on a lower substrate 130, a source electrode 136 and a drain electrode 138 formed in a layer different from that of the gate electrode 134. Herein, the drain electrode 138 is formed to contact a pixel electrode 144 through a drain contact hole 142. The drain electrode 138 contacts the pixel electrode 144 or the adjacent thin film transistor TFT.

Semiconductor layer is deposited to form a conduction channel between the gate electrode 134, the source electrode 136 and the drain electrode 138. Herein, the semiconductor layer is composed of an active layer 140 and an ohmic contact layer 146. The ohmic layer 146 is formed between the active layer 140 and the source electrode 136, and between the active layer 140 and the drain electrode 138. The active layer 140 is formed of the amorphous silicon, and not doped with impurities. The ohmic contact layer 146 is formed of the amorphous silicon, and doped with impurities of n-type or p-type. The semiconductor layer 140 and 146 applies a voltage supplied to the source electrode 136 to the drain electrode 138, when the voltage is applied to the gate electrode 134. A gate insulating layer 132 is formed between the gate electrode 134 and the semiconductor layer 140 and 146. A protective layer 148 is formed on the source electrode 136 and the drain electrode 138. The source electrode 136 and the drain electrode 138 of the thin film transistor TFT included in the embodiments of the present invention may be formed with the same mask as those used in the semiconductor layer 140 and 146.

As described above, according to the liquid crystal display device and driving method thereof in the present invention, a single data line drives the first and second liquid crystal cells located adjacent to each other from the left and right sides of their corresponding data line, thereby reducing the number of data lines to a half. Accordingly, the number of data driver IC's that apply the driving signal to the data line is also reduced to a half, thereby reducing its fabricating cost. Furthermore, the first liquid crystal cells and the second liquid crystal cells are alternately arranged, thereby displaying a uniform image.

It will be apparent to those skilled in the art that various modifications and variations can be made in the method and apparatus of driving a liquid crystal display device of the present invention without departing from the spirit or scope of the inventions. Thus, it is intended that the present invention covers the modifications and variations of this invention provided they come within the scope of the appended claims and their equivalents.

What is claimed is:

1. A driving apparatus of a liquid crystal display device, comprising:

a plurality of data lines;

a plurality of gate lines crossing the data lines;

a plurality of first liquid crystal cells on a first side of the data lines;

a plurality of second liquid crystal cells on a second side of the data lines;

a first switching part in each of the first liquid crystal cells and controlled by the $i^{th}$ gate line and the $(i+2)^{th}$ gate line (wherein i is a natural number); and a second switching part in each of the second liquid crystal cells and controlled by the $i^{th}$ gate line, a data driver applying a video signal to the data lines; and a gate driver sequentially applying first and second gate signals to each of the gate lines, wherein a pulse width of the first gate signal is different from that of the second gate signal, the second gate signal applied to the $i^{th}$ gate line overlapping the first gate signal applied to the $(i+2)^{th}$ gate line.

2. The driving apparatus according to claim 1, wherein the second gate signal has a width wider than the first gate signal.

3. The driving apparatus according to claim 1, wherein the first switching part applies the first video signal to the first liquid crystal cell for a first period, and the second switching part applies the second video signal to the second liquid crystal cell for a second period.

4. The driving apparatus according to claim 1, wherein the first switching part comprises:

a first TFT controlled by a second gate signal from $i^{th}$ gate line to apply a first gate signal applied to $i+2^{th}$ gate line;

a second TFT controlled by the first gate signal from the first TFT to apply the first video signal to the first liquid crystal cell, wherein the second switching part comprises:

a third TFT controlled by the second gate signal to apply the second video signal to the second liquid crystal cell.

5. The driving apparatus according to claim 1, wherein the first switching part and the second switching part alternately arranged with respect to the data lines.

6. A method of driving a liquid crystal display device, wherein the liquid crystal display device comprises:

a plurality of data lines;

a plurality of gate lines crossing the data lines;

a plurality of first liquid crystal cells on a first side of the data lines;

a plurality of second liquid crystal cells on a second side of the data lines;

a first switching part in each of the first liquid crystal cells and controlled by the $i^{th}$ gate line and the $(i+2)^{th}$ gate line (wherein i is a natural number); and a second switching part in each of the second liquid crystal cells and controlled by the $i^{th}$ gate line, the method comprising:

applying a first part of the second gate signal to the $i^{th}$ gate line and the first gate signal to the $(i+2)^{th}$ gate line in order to apply a first video signal to the first liquid crystal cell through the first switching part located in the $i^{th}$ horizontal line; and applying second part of the second gate signal to the $i^{th}$ gate line in order to apply a second video signal to a second liquid crystal cell through the second switching part located in the $i^{th}$ horizontal line and adjacent to the first liquid crystal cell for sharing the same data line, wherein the first and second gate signals are sequentially applied to each of the gate lines, wherein a pulse width of the first gate signal is different from that of the second gate signal.

7. The method according to claim 6, wherein the first switching part comprises:

a first TFT controlled by a second gate signal from $i^{th}$ gate line to apply a first gate signal applied to $i+2^{th}$ gate line;

a second TFT controlled by the first gate signal from the first TFT to apply the first video signal to the first liquid crystal cell, wherein the second switching part comprises:

a third TFT controlled by the second gate signal to apply the second video signal to the second liquid crystal cell.

8. The method according to claim 6, wherein the first switching part and the second switching part alternately arranged with respect to the data lines.

* * * * *